US008434400B2

(12) United States Patent
Kemnitz et al.

(10) Patent No.: US 8,434,400 B2
(45) Date of Patent: May 7, 2013

(54) PISTON FOR AN INTERNAL COMBUSTION ENGINE

(75) Inventors: Peter Kemnitz, Leutenbach (DE); Carmen Klusch, Luwigsburg (DE); Rainer Scharp, Vaihingen (DE)

(73) Assignee: MAHLE International GmbH, Stuttgart (DE)

( * ) Notice: Subject to any disclaimer, the term of this patent is extended or adjusted under 35 U.S.C. 154(b) by 732 days.

(21) Appl. No.: 12/460,196

(22) Filed: Jul. 15, 2009

(65) Prior Publication Data

US 2010/0050862 A1 Mar. 4, 2010

(30) Foreign Application Priority Data

Sep. 2, 2008 (DE) ..... 10 2008 045 456

(51) Int. Cl.
*F01B 31/08* (2006.01)

(52) U.S. Cl.
USPC ..... 92/176; 92/231; 92/260

(58) Field of Classification Search ..... 92/172, 92/176, 186, 208, 217, 231, 260; 123/41.35, 123/193.6; 29/888.042
See application file for complete search history.

(56) References Cited

U.S. PATENT DOCUMENTS

| | | | | |
|---|---|---|---|---|
| 5,769,306 | A * | 6/1998 | Colligan | 228/112.1 |
| 5,934,174 | A * | 8/1999 | Abraham et al. | 92/222 |
| 6,213,379 | B1 * | 4/2001 | Takeshita et al. | 228/112.1 |
| 6,557,514 | B1 | 5/2003 | Gaiser | |
| 7,104,183 | B2 * | 9/2006 | Huang | 92/186 |
| 8,011,288 | B2 * | 9/2011 | Gniesmer et al. | 92/231 |
| 2003/0051694 | A1 * | 3/2003 | Gaiser et al. | 123/193.6 |
| 2011/0119914 | A1 * | 5/2011 | Janssen et al. | 29/888.04 |

FOREIGN PATENT DOCUMENTS

| | | |
|---|---|---|
| DE | 25 37 182 | 3/1977 |
| DE | 10 2004 061 778 | 4/2006 |
| WO | WO 2004/044409 | 5/2004 |
| WO | WO 2005/060315 | 6/2005 |

* cited by examiner

*Primary Examiner* — Edward Look
*Assistant Examiner* — Logan Kraft
(74) *Attorney, Agent, or Firm* — Collard & Roe, P.C.

(57) ABSTRACT

A piston for an internal combustion engine has a lower piston part and an upper piston part that are connected with one another by friction welding and form an outer circumferential cooling channel. The upper piston part has a circumferential ring belt provided with ring grooves, the inner wall of which delimits the circumferential outer cooling channel. An outer circumferential friction-weld seam is provided below the ring belt, the width of which seam is less than or equal to the wall thickness between the groove root of the ring grooves and the inner wall of the ring belt.

6 Claims, 3 Drawing Sheets

PISTON FOR AN INTERNAL COMBUSTION ENGINE

CROSS REFERENCE TO RELATED APPLICATIONS

Applicants claim priority under 35 U.S.C. 119 of German Application No. 10 2008 045 456.7 filed Sep. 2, 2008.

BACKGROUND OF THE INVENTION

1. Field of the Invention

The present invention relates to a piston for an internal combustion engine, having a lower piston part and an upper piston part that are connected with one another by friction welding and form an outer circumferential cooling channel. The upper piston part has a circumferential ring belt provided with ring grooves, the inner wall of which delimits the circumferential outer cooling channel.

2. The Prior Art

A piston of this type is described in U.S. Pat. No. 6,557,514 B1. The outer circumferential friction-weld seam between the upper piston part and the lower piston part is disposed in the region of the ring belt, between two ring grooves. In this connection, however, there is the risk that tension is built up during friction welding, which impairs the stability of the piston.

SUMMARY OF THE INVENTION

It is therefore an object of the invention to provide a piston where the risk of tension is reduced and the stability of the piston is improved.

This object is accomplished according to the invention by a piston having an outer circumferential friction-weld seam provided below the ring belt, the width of which seam is less than or equal to the wall thickness between the groove root of each of the ring grooves, and the inner wall of the ring belt.

Within the scope of the present disclosure, this is understood to mean that usual production tolerances are included. The width of the outer circumferential friction-weld seam and the wall thickness therefore lie within the scope of the usual production tolerances.

The piston according to the invention is very stable, despite the clearly reduced width of the friction-weld seam as compared with the state of the art (and, going along with this, the clearly reduced wall thickness of the ring belt in the region of the friction-weld seam). At the same time, the piston according to the invention demonstrates improved flexibility. Thus, the piston according to the invention can better absorb the forces that act on the piston crown during the combustion process, and pass them off more uniformly over its structure. Another great advantage of the piston according to the invention consists in that a saving of material and weight is achieved by the reduction in the wall thickness in the region of the outer circumferential friction-weld seam.

The width of the outer circumferential friction-weld seam is preferably precisely as great as the wall thickness between the groove root of each of the ring grooves, and the inner wall of the ring belt, thereby achieving an optimal force flow at optimal material utilization.

The piston according to the invention can have support elements between an inner region and the outer circumferential cooling channel, which elements are connected with one another by way of an inner circumferential friction-weld seam.

The width of the inner circumferential friction-weld seam can be greater than, equal to, or less than the width of the outer circumferential friction-weld seam. The two friction-weld connections are formed in a single work step.

In the case of this preferred embodiment of the present invention, the width of the inner friction-weld seam is less than what has been known in the state of the art until now. Nevertheless, the piston according to the invention is very stable, for the reasons described above.

It is practical if the lower piston part and the upper piston part form a depression along at least one friction-weld seam, in which a weld bead that might be formed is accommodated, in order to obtain as uniform a surface as possible along the friction-weld seam, and, in particular, not to reduce the size of the cooling channel, and not to impair the cooling oil flow as the result of eddies and the like.

BRIEF DESCRIPTION OF THE DRAWINGS

Other objects and features of the present invention will become apparent from the following detailed description considered in connection with the accompanying drawings, which show a schematic representation, not true to scale. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
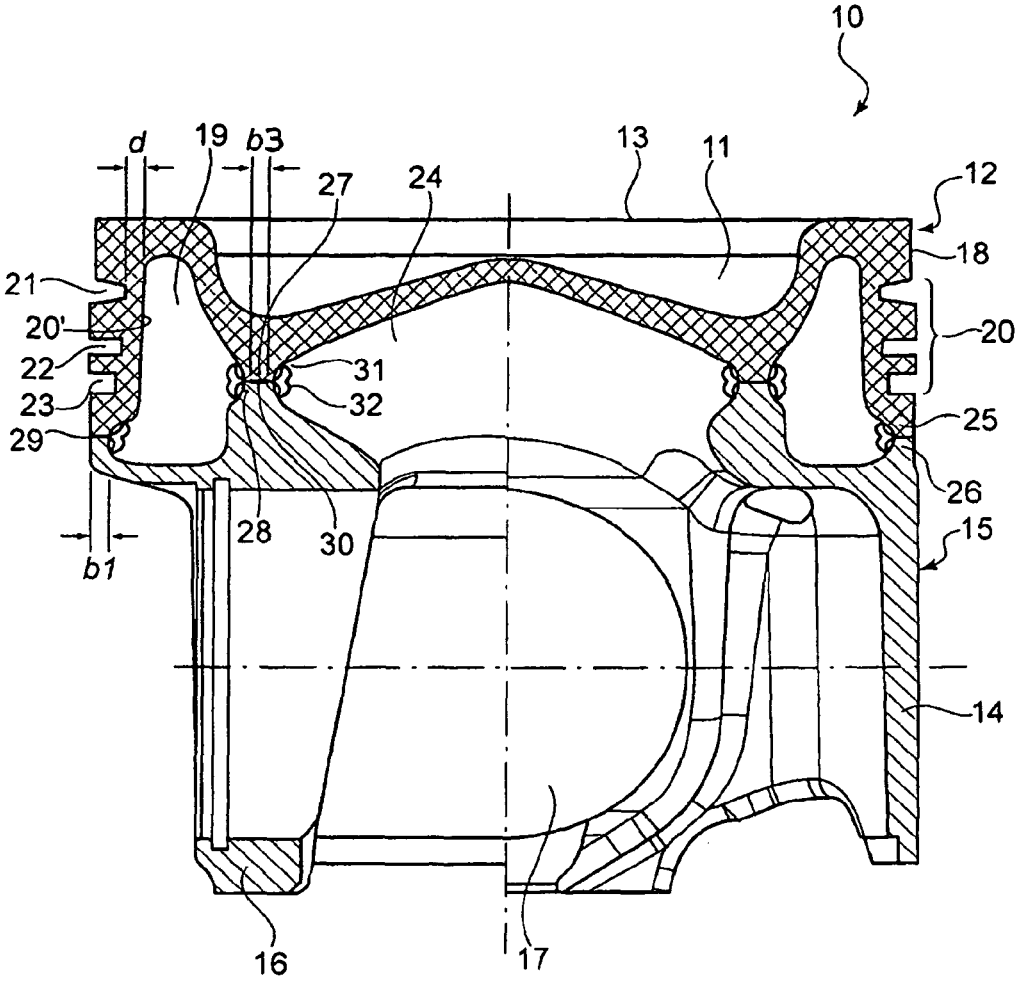
FIG. 1 shows a first embodiment of a piston according to the invention, whereby the left half of the representation is rotated by 90° as compared with the right half.
Figure 2A:
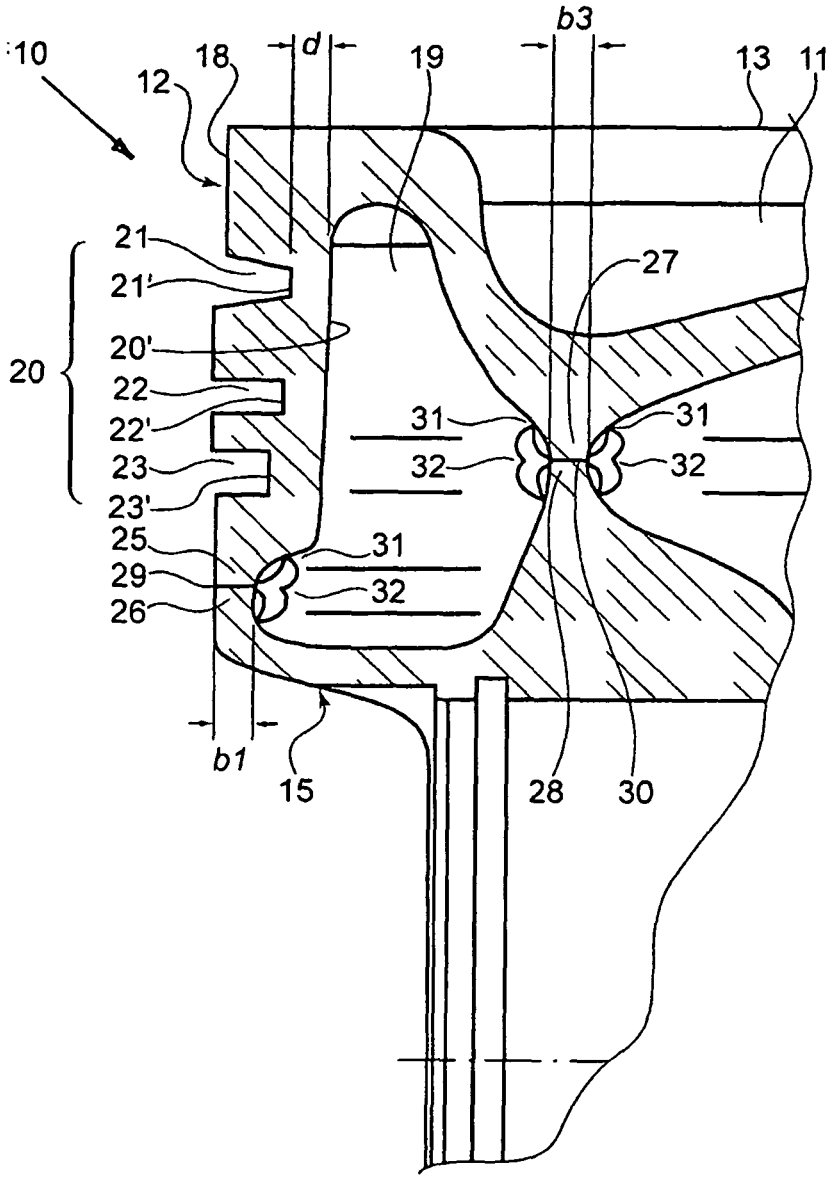
FIG. 2A is an enlarged partial representation of the piston according to FIG. 1.

Referring now in detail to the drawings, FIGS. 1 and 2A show a first embodiment of a piston 10 according to the invention. Piston 10 has a lower piston part 15 and an upper piston part 12, which are connected with one another by friction welding. Lower piston part 15 and upper piston part 12 can consist of any metallic material that is accessible to processing by friction welding.

Lower piston part 15 has a piston skirt 14 and pin bosses 16 provided with pin bores 17. Upper piston part 12 has a piston crown 13 that is provided with a combustion chamber bowl 11. Piston crown 13 is followed by an outer circumferential top land 18. Below top land 18, a circumferential ring belt 20 is provided, which has three circumferential ring grooves 21, 22, 23 for piston rings (not shown). Lower piston part 15 and upper piston part 12 furthermore jointly form an outer circumferential cooling channel 19.

To form the friction-weld connections, upper piston part 12 is provided with a circumferential outer support element 25 and a circumferential inner support element 27. In a corresponding manner, lower piston part 15 is also provided with a circumferential outer support element 26 and a circumferential inner support element 28. Outer support elements 25, 26 form an outer circumferential friction-weld seam 29 below ring belt 20, while inner support elements 27, 28 form an inner circumferential friction-weld seam 30 below piston crown 13. Inner support elements 27, 28 separate outer circumferential cooling channel 19 from an inner region 24 of piston 10. Inner wall 20' of ring belt 20 forms the outer wall of outer circumferential cooling channel 19.

Outer friction-weld seam 29 has a width b1 that is as great as the wall thickness d of ring belt 20 between groove root 21', 22', 23' of each of the ring grooves 21, 22, 23, and inner wall 20' of the ring belt 20, within the scope of the usual production tolerances, in the exemplary embodiment.

The inner friction-weld seam 30 has a width b3 that is less than the width b1 of the outer friction-weld seam 29, within the scope of the usual production tolerances, in the exemplary embodiment according to FIGS. 1 and 2A. However, width b3 can also be precisely as great as width b1.

The outer and inner support elements 26, 28 and 25, 27, respectively, of lower piston part 15 and of upper piston part 12 are configured, in the region of friction-weld seams 30, 29, in such a manner that circumferential depressions 31 are formed which are oriented towards the outer circumferential cooling channel 19 and towards the inner region 24, respectively. Weld beads 32, which might be formed during the friction-welding process, are accommodated in depressions 31. In this manner, the surfaces of the walls of the cooling channel 19 are comparatively smooth in the exemplary embodiment. As a result, the volume of the cooling channel 19 for accommodating cooling oil remains unimpaired. Furthermore, the cooling oil can flow in the cooling channel 19 in essentially undisturbed manner. The cooling effect of the cooling oil is thus essentially maintained in the case of this advantageous configuration of the piston according to the invention.

Figure 2B:
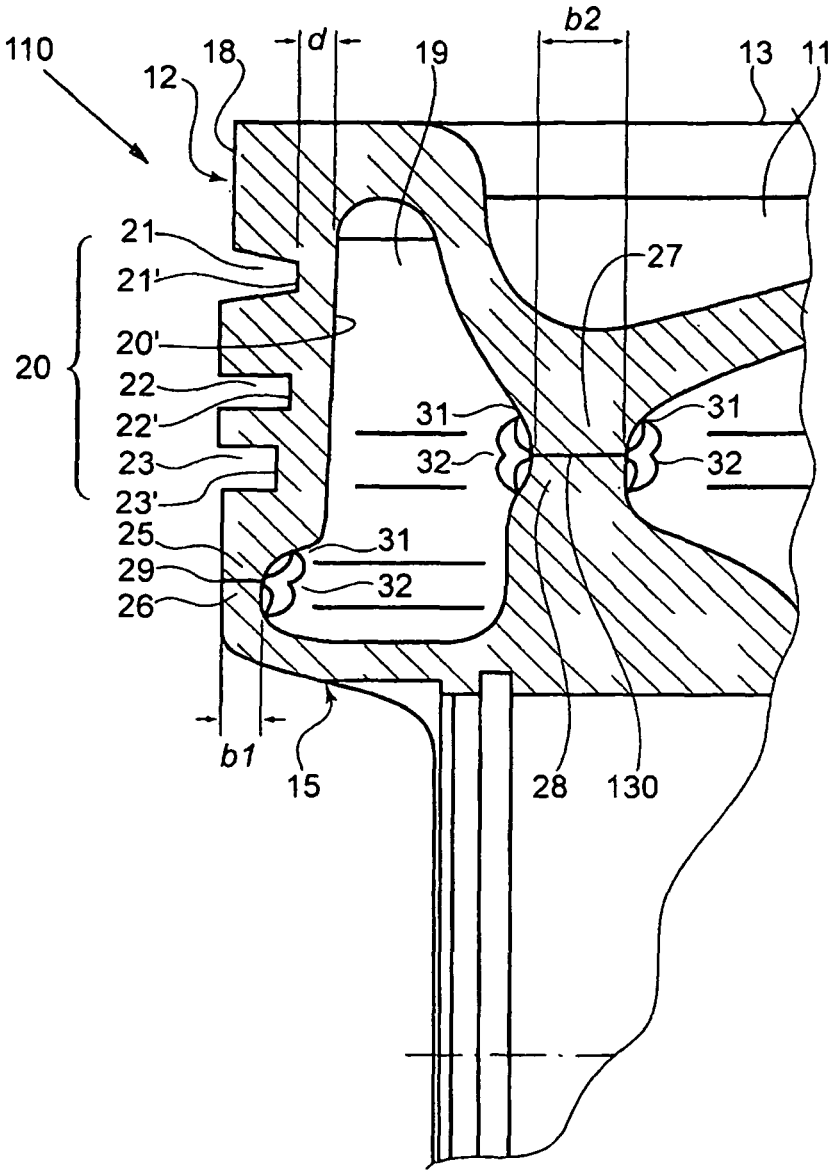
FIG. 2B is an enlarged partial representation of another embodiment of a piston according to the invention.

FIG. 2B shows another exemplary embodiment of a piston 110, comparable to FIG. 1A. Piston 110 differs from piston 10 only in that inner friction-weld seam 130 has a width b2 that is greater than width b1 of outer friction-weld seam 29, within the scope of the usual production tolerances.

Accordingly, while only a few embodiments of the present invention have been shown and described, it is obvious that many changes and modifications may be made thereunto without departing from the spirit and scope of the invention.

What is claimed is:

1. A piston for an internal combustion engine, comprising:

a lower piston part; and an upper piston part connected with the lower piston part by friction welding to form jointly an outer circumferential cooling channel, said upper piston part having a circumferential ring belt provided with ring grooves, an inner wall of said ring belt delimiting the outer circumferential cooling channel, wherein an outer circumferential friction-weld seam is provided below the ring belt, said outer circumferential weld seam having a width that is at most equal to a wall thickness between a groove root of each of the ring grooves and the inner wall of the ring belt.

2. The piston according to claim 1, wherein the width of the outer circumferential friction-weld seam is equal to the wall thickness between the groove root of each of the ring grooves and the inner wall of the ring belt.

3. The piston according to claim 1, wherein an inner circumferential friction-weld seam is provided between an inner region of the piston and the outer circumferential cooling channel.

4. The piston according to claim 3, wherein a width of the inner circumferential friction-weld seam is at least as great as the width of the outer friction-weld seam.

5. The piston according to claim 3, wherein a width of the inner circumferential friction-weld seam is less than the width of the outer friction-weld seam.

6. The piston according to claim 1, wherein the lower piston part and the upper piston part form a depression along at least one of the friction-weld seams, to accommodate a weld bead.

* * * * *